US010583980B2

(12) United States Patent
French

(10) Patent No.: US 10,583,980 B2
(45) Date of Patent: Mar. 10, 2020

(54) PILL-DISPENSING PACKAGE

(71) Applicant: Berry Plastics Corporation, Evansville, IN (US)

(72) Inventor: Jordan French, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

(21) Appl. No.: 15/647,404

(22) Filed: Jul. 12, 2017

(65) Prior Publication Data

US 2018/0029778 A1 Feb. 1, 2018

Related U.S. Application Data

(60) Provisional application No. 62/368,487, filed on Jul. 29, 2016.

(51) Int. Cl.
*B65D 83/04* (2006.01)
*A61J 1/03* (2006.01)

(52) U.S. Cl.
CPC ..... *B65D 83/0409* (2013.01); *A61J 1/03* (2013.01)

(58) Field of Classification Search
CPC ..... B65D 83/0409; A61J 1/03
USPC ..... 221/154, 266, 1, 246, 263, 162, 65, 64, 221/260
See application file for complete search history.

(56) References Cited

U.S. PATENT DOCUMENTS 716,257 A * 12/1902 Lunt ..... B65D 47/061 222/522
1,172,079 A 2/1916 Lea Vell
2,673,777 A * 3/1954 Ward ..... B65D 83/0409 221/200
2,683,554 A * 7/1954 Mulhauser, Jr. ... B65D 83/0409 221/152
2,886,208 A * 5/1959 Sinclair ..... B65D 83/0481 221/288
2,918,167 A 12/1959 Lowen
2,962,190 A * 11/1960 Horland ..... B65D 83/0409 221/202
3,067,787 A 12/1962 Salk
3,159,308 A * 12/1964 Passavanti ..... B65D 83/0409 221/289
3,289,885 A * 12/1966 Villaveces ..... B65D 47/265 221/288
3,325,052 A 6/1967 Sauber
3,586,208 A * 6/1971 Hussey ..... B65D 83/0409 221/299

(Continued)

FOREIGN PATENT DOCUMENTS

CA 2130881 2/1996
CA 2130881 A1 2/1996

(Continued)

OTHER PUBLICATIONS

Office Action dated Jan. 12, 2018 for U.S. Appl. No. 15/396,983; (pp. 1-9).

(Continued)

*Primary Examiner* — Rakesh Kumar
(74) *Attorney, Agent, or Firm* — Barnes & Thornburg LLP

(57) ABSTRACT

A pill-dispensing package includes a container and a closure. The container is formed to include an interior product-storage region to store pills therein. The closure is coupled to a filler neck of the container.

12 Claims, 5 Drawing Sheets

(56) References Cited

U.S. PATENT DOCUMENTS 3,610,468 A 10/1971 Borsum
3,622,041 A * 11/1971 Borsum ..... B65D 51/24 221/202
3,627,160 A * 12/1971 Horvath ..... B65D 50/061 215/223
3,716,161 A 2/1973 Julian et al.
3,833,147 A 9/1974 Borsum
3,836,055 A 9/1974 Katzmark
4,159,791 A 7/1979 Crutcher
4,230,236 A * 10/1980 Boulter ..... B65D 83/0409 221/190
4,282,990 A * 8/1981 Miyashita ..... G01F 11/261 206/540
4,283,000 A * 8/1981 White ..... B65D 5/722 221/312 R
4,454,962 A 6/1984 Greenspan
4,530,447 A * 7/1985 Greenspan ..... B65D 83/04 221/288
4,653,668 A * 3/1987 Gibilisco ..... B65D 83/0409 206/540
4,744,492 A * 5/1988 Hackmann ..... B65D 83/0409 206/540
4,805,765 A * 2/1989 Barrett ..... B65D 5/724 206/738
4,848,593 A * 7/1989 Jeandaud ..... B65D 83/049 221/207
4,887,738 A 12/1989 Jennings
4,971,203 A * 11/1990 Weinstein ..... B65D 83/0481 206/536
5,018,644 A * 5/1991 Hackmann ..... B65D 83/0409 221/152
5,020,719 A * 6/1991 Roth ..... B65D 5/5213 221/302
5,108,006 A * 4/1992 Tieke ..... B65D 83/0409 221/152
5,405,047 A * 4/1995 Hansen ..... B65D 83/0409 221/190
5,443,204 A * 8/1995 O'Donnell ..... B65D 5/724 221/305
5,467,903 A * 11/1995 Sorensen ..... G01F 11/261 222/455
5,711,463 A 1/1998 Chen
5,873,493 A 2/1999 Robinson
5,897,025 A 4/1999 Flewitt
6,267,265 B1 * 7/2001 Issa ..... A61J 7/0076 221/263
6,695,178 B2 2/2004 Eppler
7,147,130 B1 12/2006 Clark
7,780,008 B2 8/2010 Portier
8,322,567 B2 12/2012 Giraud
8,469,194 B2 6/2013 Johnson
9,656,796 B1 * 5/2017 Cammarata ..... B65D 83/0409
2004/0045978 A1 3/2004 Peng
2004/0124204 A1 * 7/2004 Giraud ..... B65D 83/0409 221/263
2009/0194556 A1 * 8/2009 Klein ..... B65D 50/062 221/154
2011/0147252 A1 6/2011 Rasheed
2011/0147404 A1 * 6/2011 Dobie, III ..... B65D 47/265 221/306
2015/0266654 A1 9/2015 Baarman
2015/0368011 A1 12/2015 Groubert
2017/0036846 A1 * 2/2017 Bressan ..... A61J 7/0076
2017/0190503 A1 7/2017 French

FOREIGN PATENT DOCUMENTS

WO 02009012080 1/2009
WO 2013172487 A1 11/2013

OTHER PUBLICATIONS

International (PCT) Search Report and Written Opinion for PCT App. No. PCT/US2017/12032 dated Apr. 3, 2017, BP-464 PCT ||, 10 pages.
Office Action dated Aug. 8, 2018 for U.S. Appl. No. 15/396,983, BP-464 US-U ||, (pp. 1-11).
Chinese Office Action for Chinese App. No. 201780011765.7 dated Apr. 28, 2019, BP-464 CN ||, 14 pages.
Office Action dated Jun. 13, 2019 for U.S. Appl. No. 15/396,983, BP-464 US-U ||, 15 pages.
Office Action dated Jan. 28, 2019 for U.S. Appl. No. 15/396,983, BP-464 US-U ||, (pp. 1-11).
Extended European Search Report for European Pat. App. No. 17736199.5 dated Aug. 19, 2019, BP-464 EP ||, 6 pages.

* cited by examiner

PILL-DISPENSING PACKAGE

PRIORITY CLAIM

[US] This application claims priority under 35 U.S.C. § 119(e) to U.S. Provisional Application Ser. No. 62/368,487, filed Jul. 29, 2016, which is expressly incorporated by reference herein.

BACKGROUND

The present disclosure relates to packages, and in particular, to a package including a container and a container closure coupled selectively to the container. More particularly, the present disclosure relates to a pill-dispensing package that is configured to dispense a pill.

SUMMARY

According to the present disclosure, a pill-dispensing package includes a container and a container closure adapted to be coupled to the container. In illustrative embodiments, the container includes a body and a filler neck that cooperate together to form an interior pill-storage region to store pills therein. The container closure is coupled to the container normally to block access to the interior pill-storage region.

In illustrative embodiments, the container further includes a pill dispenser coupled to the filler neck. The pill dispenser is arranged to lie between the container closure and the filler neck. The pill dispenser is configured to dispense a single pill from the interior pill-storage region through a pill-outlet aperture to a pill-receiving dish when the container is rotated to a partly inverted position so that the unintended spilling of pills is minimized.

In illustrative embodiments, the pill dispenser includes a neck mount, a pill-return funnel, and a pill-dispensing cap. The neck mount is arranged to couple the pill dispenser to the filler neck. The pill-return funnel is coupled to the neck mount and configured to guide excess pills back into the container. The pill-dispensing cap is coupled to the pill-return funnel and arranged to extend upwardly away from pill-return funnel towards the container closure.

In illustrative embodiments, the pill-dispensing cap is formed to provide a space to receive the pills within the pill-dispensing cap when a user rotates the container to the side allowing pills to move from the interior pill-storage region through the filler neck to the pill-dispensing cap. In illustrative embodiments, pills may then be discharged from the pill-dispensing cap using pill-discharge apertures formed in curved pill-discharge units included in the pill-dispensing cap. In illustrative embodiments, the pill-return funnel is formed to allow excess pills to re-enter the interior pill-storage region after the desired amount of pills has been discharged by the user.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

Figure 2:
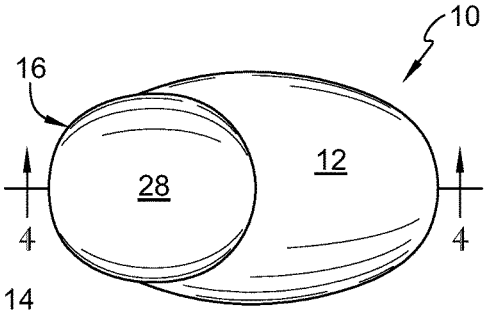
FIG. 2 is a top plan view of the pill-dispensing package of FIG. 1 showing the container closure mounted on the container.
Figure 4:
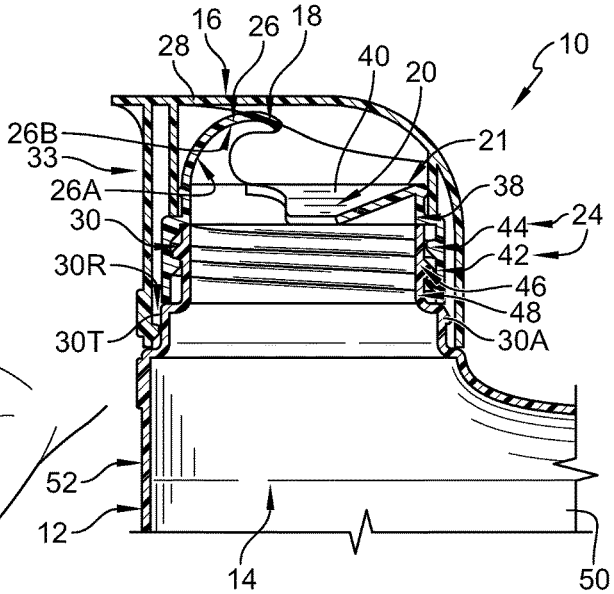
Figure 5:
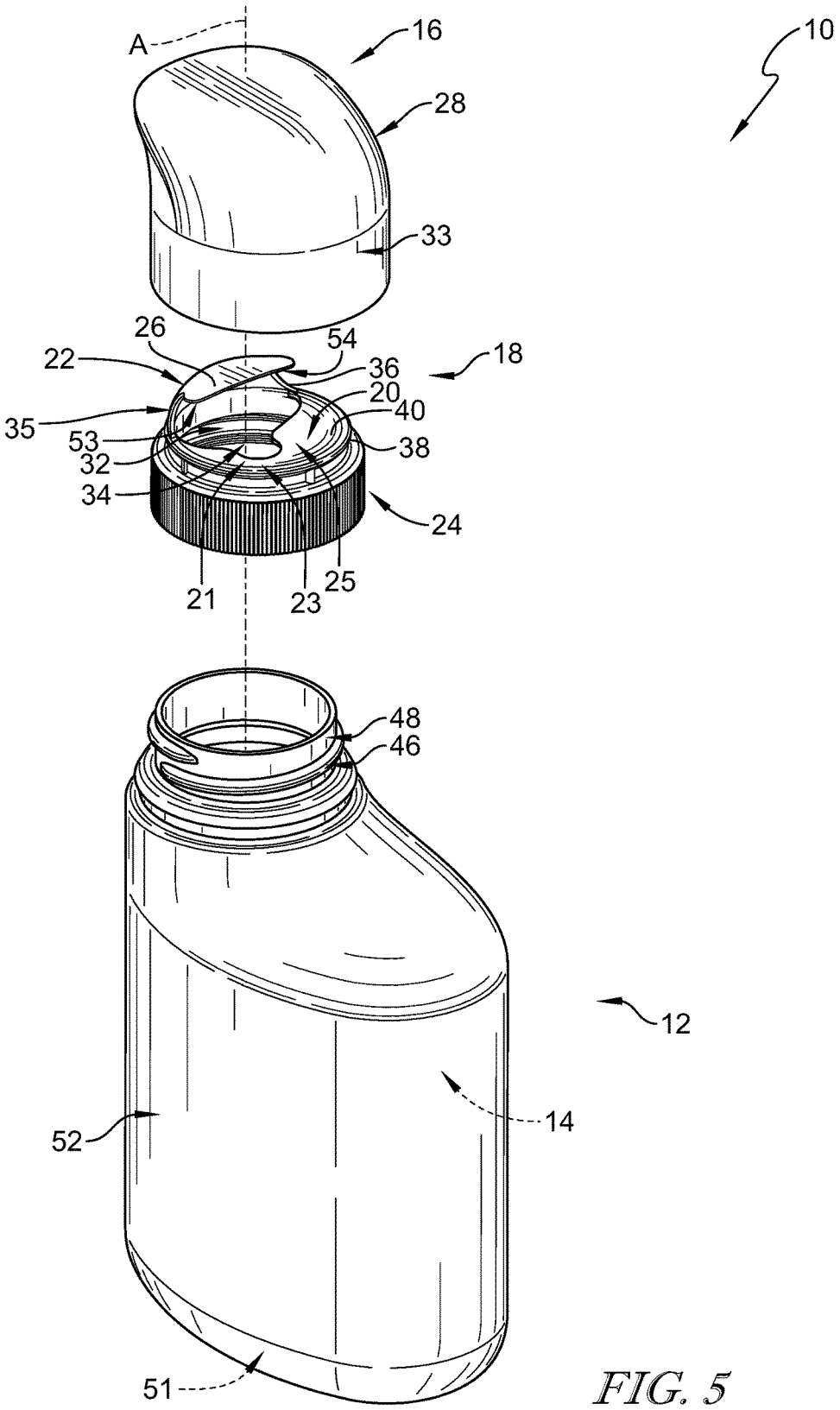
Figure 7:
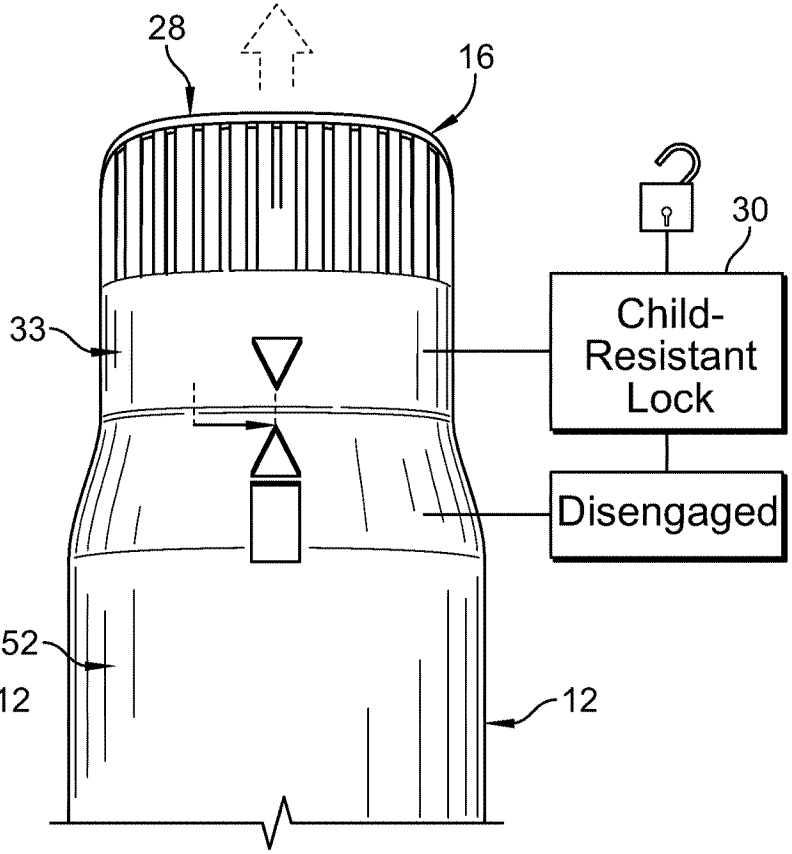
Figure 6:
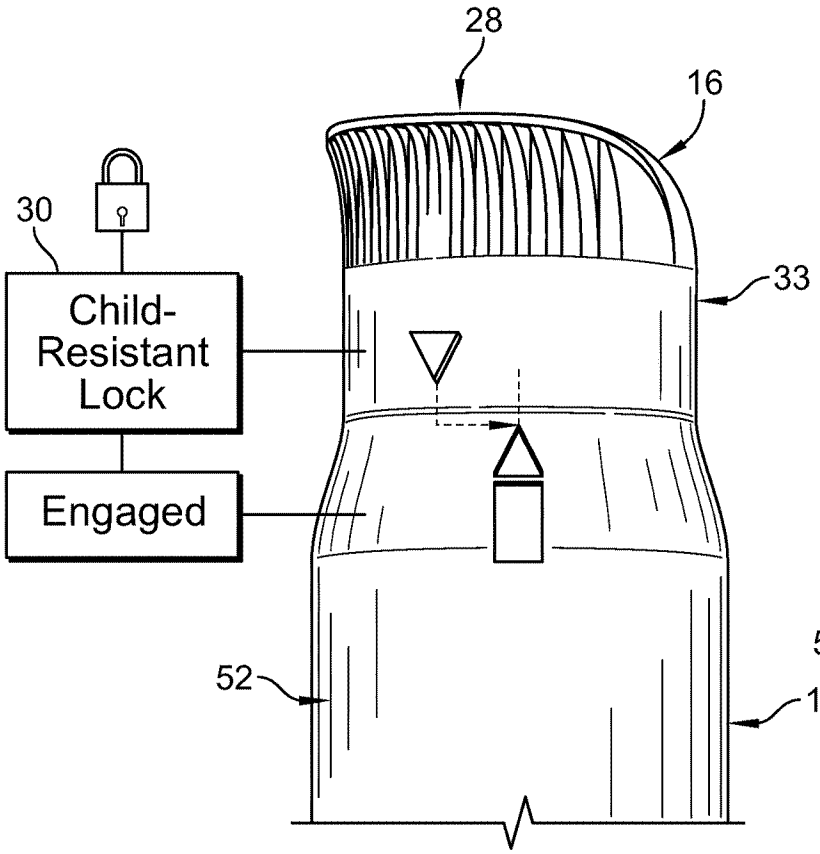
Figure 8:
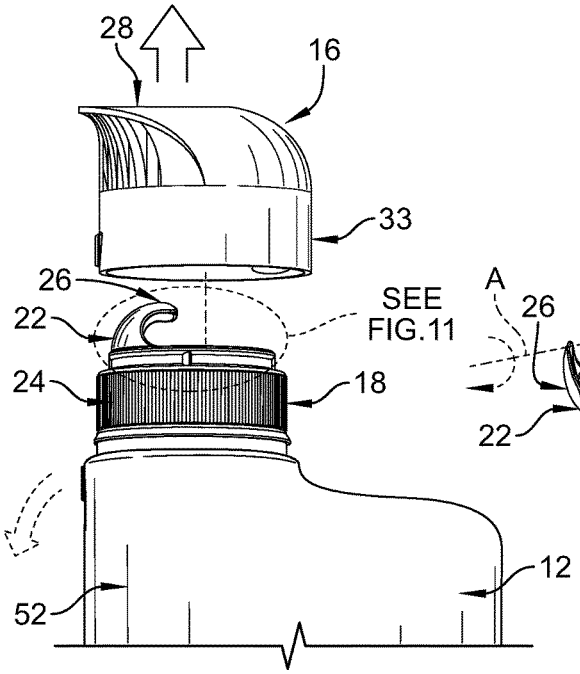
Figure 9:
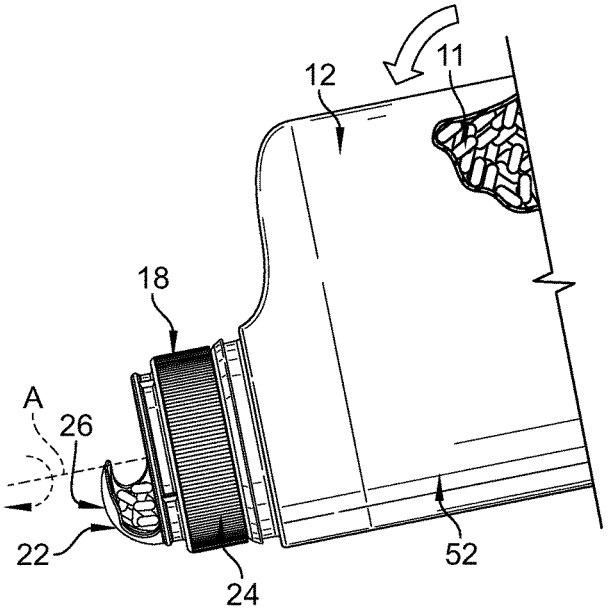
Figure 10:
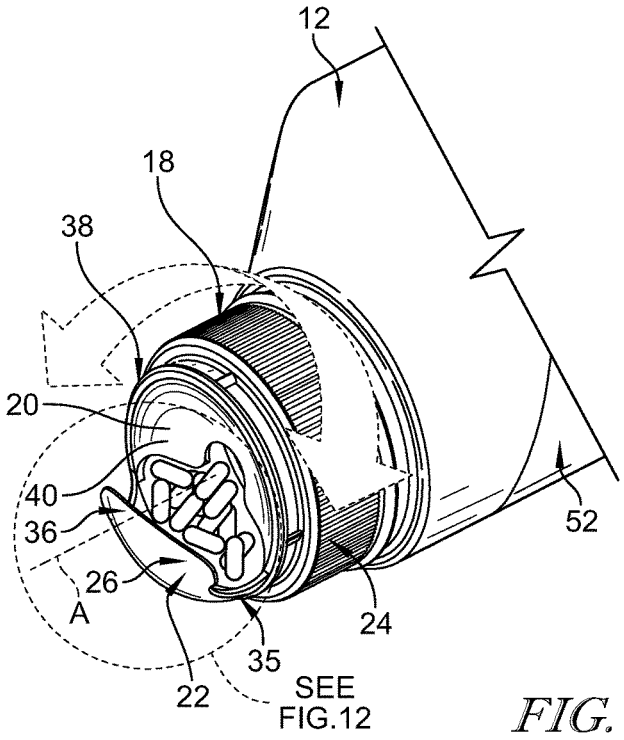
Figure 11:
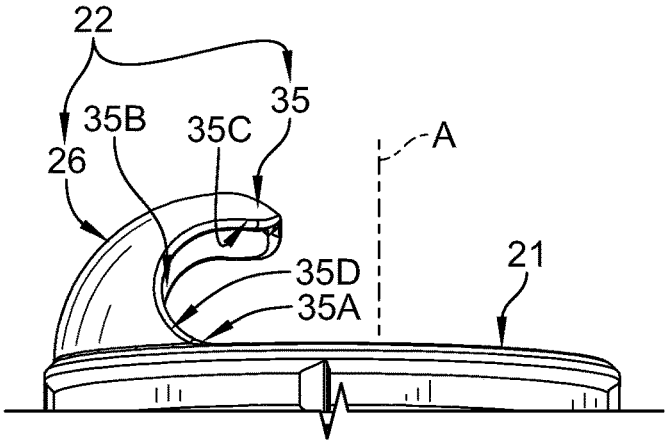
Figure 12:
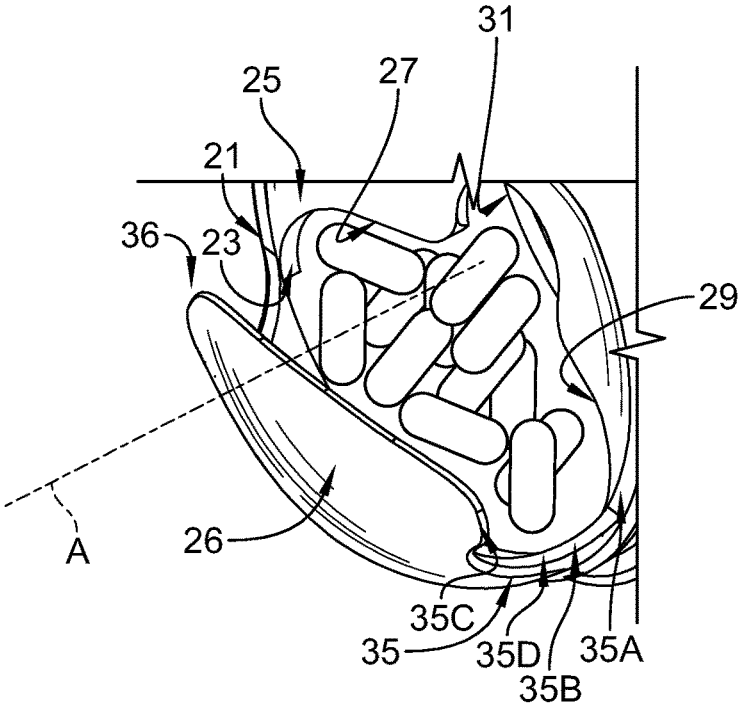

FIG. 4 is an enlarged sectional view taken along line 4-4 of FIG. 2 showing that the pill dispenser and the container closure cooperate to form a child-resistant lock, the pill dispenser includes a pill-return funnel extending at an angle from a pill-return aperture towards the filler neck, and the lid of the container closure covers the pill dispenser normally to block access to the pill dispenser and the pill-return funnel;

FIG. 5 is an exploded assembly view of the pill-dispensing package of FIGS. 1-4 showing that the pill-dispensing package includes, from top to bottom, the container closure including the lid and a container mount, the pill dispenser includes a pill-dispensing cap, the pill-return funnel, and a neck mount, and the container including a body, the filler neck, a neck thread coupled to the filler neck;

FIGS. 6 and 7 are a series of views showing engagement of an illustrative process for disengaging the child-resistant lock to allow removal of the closure to expose the pill dispenser as suggested in FIG. 8;

FIG. 6 is a front elevation view of the pill-dispensing package with the child-resistant lock in an engaged arrangement in which the child-resistant lock blocks removal of the container closure from the container;

FIG. 7 is a view similar to FIG. 6 showing the pill-dispensing package with the child-resistant lock in a disengaged arrangement as a result of rotating the container closure to an aligned position to allow removal of the container closure from the container;

FIG. 8 is a partial perspective view of the pill-dispensing package in an opened arrangement in which the container closure has been separated from the container to expose the pill dispenser as suggested in FIGS. 9 and 10;

FIGS. 9 and 10 are a series of views showing discharge of a single pill from the container through the pill dispenser after the container closure has been removed from the container;

FIG. 9 is a perspective view of the pill-dispensing package after the container closure has been removed and demonstrating that several pills may be discharged through the pill-outlet aperture formed in the pill dispenser and retained in the pill-receiving dish so that a single pill may be dispensed from the pill-receiving dish through a pill-discharge unit as suggested in FIG. 10;

FIG. 10 is an enlarged partial perspective view of pill-dispensing package of FIG. 9 showing that a single pill is dispensed from the pill-discharge unit through a pill-discharge aperture formed in the pill-dispensing cap in response to rotating the container to the right or left (phantom double arrow);

FIG. 11 is an enlarged detail view of the circled region of FIG. 8 showing the first pill-discharge unit of the pill dispenser; and FIG. 12 is an enlarged detail view of the circled region of FIG. 10.

DETAILED DESCRIPTION

A pill-dispensing package 10 in accordance with the present disclosure is shown, for example, in FIGS. 1, 2, 4, and 5. Pill-dispensing package 10 is configured to dispense a single pill 11 during a partial inversion process as shown in FIGS. 6-10. This process minimizes unexpected release of additional pills 11 from an interior product-storage region 14 formed pill-dispensing package 10.

Figure 1:
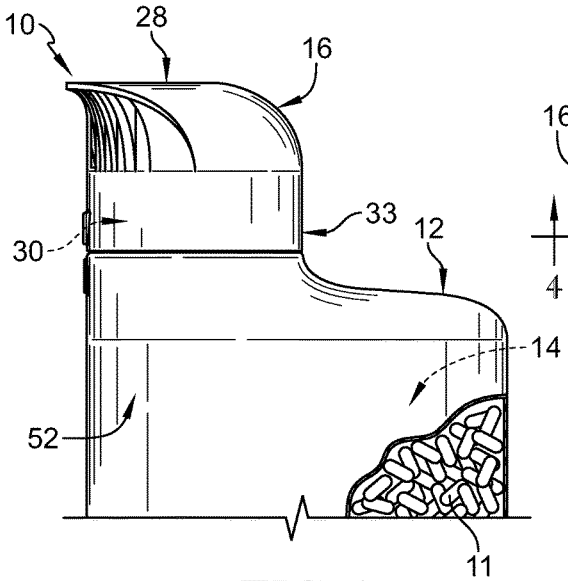
FIG. 1 is a side elevation view of a pill-dispensing package in accordance with the present disclosure showing that the pill-dispensing package includes, from bottom to top, a container formed to include an interior pill-storage region for housing pills and a closure mounted on the underlying container normally to block access to the interior pill-storage region.
Figure 3:
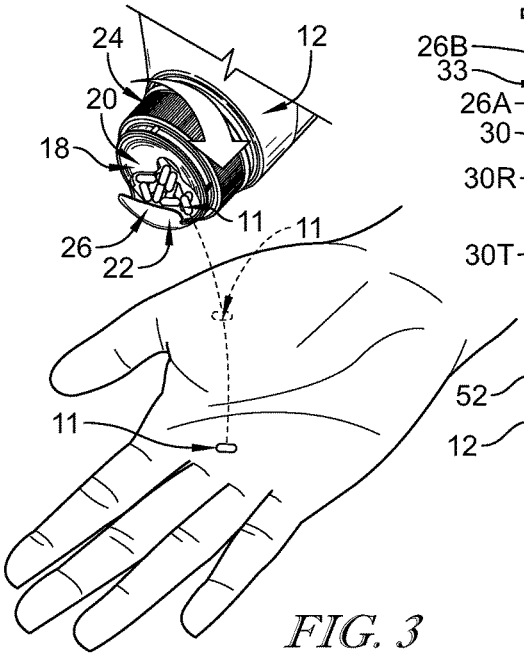
FIG. 3 is an enlarged diagrammatic view of the pill-dispensing package of FIGS. 1 and 2 showing a pill dispenser coupled to a filler neck of the container and suggesting that a single pill is dispensed from the pill dispenser in response to rotating the container and pill dispenser toward a user's hand.

Pill-dispensing package 10 includes a container 12, a container closure 16, and a pill dispenser 18 as suggested in FIGS. 4, and 5. Container 12 is formed to include interior product-storage region 14 adapted to store pills 11 therein. Container closure 16 is coupled to container 12 to block access to pill dispenser 18 while container closure 16 is mounted on container 12 as shown in FIGS. 1, and 4. Pill dispenser 18 is located between container closure 16 and container 12 when container closure 16 is mounted on container 12 as shown in FIGS. 1 and 2. Pill dispenser 18 minimizes discharge of more than one pill at a time as shown in FIG. 3. Container 12 and pill dispenser 18 cooperate to dispense a single pill 11 during a partial inversion process as shown in FIGS. 6-10.

Container 12 includes a body 50, a filler neck 48, and neck threads 46 as shown in FIGS. 4 and 5. Body 50 is coupled to filler neck 48 and includes a floor 51 and a sidewall 52 extending from floor 51 towards filler neck 48. Filler neck 48 is arranged to open into interior product-storage region 14. Neck threads 46 extend circumferentially around filler neck 48. Body 50 and filler neck 48 cooperate to form interior product-storage region 14 to store pill 11 therein as shown in FIGS. 4 and 5.

Container closure 16 includes a lid 28 and a container mount 33 as shown in FIGS. 1 and 2. Lid 28 is arranged to overlie pill dispenser 18 when container closure 16 is mounted on container 12. Container mount 33 extends downwardly from lid 28 to surround circumferentially a portion of filler neck 48 and locate a portion of pill dispenser 18 therebetween.

Pill dispenser 18 includes a neck mount 24, a pill-return funnel 20, and a pill-dispensing cap 22 as shown in FIG. 5. Neck mount 24 is coupled to filler neck 48 in a fixed position relative to container 12 as shown in FIGS. 3 and 4. Pill-return funnel 20 is coupled to neck mount 24 in a fixed position relative to neck mount 24 and configured to guide excess pills 11 back into interior product-storage region 14 after the user has obtained pills 11 desired from pill-dispensing cap 22. Pill-dispensing cap 22 is coupled to pill-return funnel 20 in a fixed position relative to pill-return funnel 20 and is arranged to extend upwardly away from pill-return funnel 20 toward container closure 16. Pill-dispensing cap 22 is configured to receive several pills 11 therein from container 12 and control discharge of pills 11 so that only one pill 11 at a time is discharged to the user as suggested in FIGS. 3 and 10.

Pill-dispensing cap 22 includes a pill-receiving dish 26 and first and second pill-discharge units 35, 36 as shown in FIGS. 3, 5, 11, and 12. Pill-receiving dish 26 is coupled to neck mount 24 and arranged to extend upwardly away from pill-return funnel 20 and container 12. First pill-discharge unit 35 is located in spaced-apart relation to second pill-discharge unit 36 to locate pill-receiving dish 26 therebetween. First and second pill-discharge units 35, 36 extend between pill-return funnel 20 and pill-receiving dish 26 as shown, for example, in FIG. 3. Each pill-discharge unit 35, 36 is formed to include a discharge aperture 53, 54 as shown in FIG. 5.

First pill-discharge unit 35 is similar to second pill-discharge unit 36, and thus, only first pill-discharge unit 35 will be discussed in detail below. First pill-discharge unit 35 includes a base 35A, an arm 35B, and a platform 35C. Base 35A, arm 35B, and platform 35C each provide a segment which cooperate together to provide an edge 35D that defines at least a portion of discharge apertures 53, 54. In one example, the segment of base 35A has a first curved shaped, the segment of arm 35B has a different second curved shape, and the segment of platform 35C has a straight linear shape.

Pill-receiving dish 26 includes first curved portion 26A and a second curved portion 26B as shown in FIG. 4. Second curved portion 26B is arranged to lie in spaced-apart relation to pill-return funnel 20 to locate first curved portion 26A therebetween. First curved portion 26A has a first radius of curvature. Second curved portion 26B has a second radius of curvature. In one example, the first radius of curvature is larger than the second radius curvature. In another example, the first radius of curvature is less than the second radius of curvature. Pill-receiving dish 26 is curved to retain pills 11 as the user tilts container 12 as shown in FIGS. 3, 9, and 10. Pill-receiving dish 26 extends upwardly away from container 12 and is located between lid 28 and neck 48 container closure 16 is mounted on container 12.

Pill-receiving dish 26 cooperates with a funnel mount 38 of pill-return funnel 20 and an outer tip of pill-receiving dish 26 to form discharge apertures 53, 54. Discharge aperture 54 is substantially similar to discharge aperture 53, and thus, only discharge aperture 53 will be described in detail. Discharge aperture 53 is formed along first and second curved portions 26A, 26B to provide an aperture through which the user may obtain a single pill 11 as shown in FIGS. 3 and 10. Discharge apertures 53, 54 allow for one pill 11 at a time to be dispensed through either discharge aperture 53, 54 in response to tilting movement of pill-dispensing package 10 as suggested in FIGS. 3 and 10.

Pill-return funnel 20 includes funnel mount 38 and a sloped side wall 40 as shown in FIG. 5. Funnel mount 38 is coupled to neck mount 24 in a fixed position relative to neck mount 24 as shown in FIG. 4. Sloped side wall 40 is coupled to funnel mount 38 in a fixed position relative to funnel mount 38. Sloped side wall 40 is arranged to extend downwardly from funnel mount 38 toward interior product-storage region 14 as shown in FIGS. 3 and 4.

Sloped side wall 40 is formed to include a pill-outlet aperture 32 and a pill-return aperture 34 as shown in FIG. 5. When container 12 is tilted to the position shown in FIGS. 3, 9 and 10, several pills 11 move from interior product-storage region 14 through pill-outlet aperture 32 to be received in pill-receiving dish 26. Once the user has obtained the desired number of pills, sloped side wall 40 guides excess pills back into interior product-storage region 14 through pill-return aperture 34. Pill-outlet aperture 32 opens into pill-return aperture 34 to allow pills to move between interior product-storage region 14 and pill-dispensing cap 22 as suggested in FIG. 3. Any pills 11 that may exit pill-outlet aperture 32 unintentionally while the pill-dispensing package 10 is not in use will be contained by the lid 28 and redirected into pill-return aperture 34 by pill-return funnel 20.

Pill-return funnel 20 further includes a perimeter edge 21 arranged to extend circumferentially around pill-dispensing cap 22 as shown in FIGS. 5, 11, and 12. Perimeter edge 21 includes a mount section 23 and an aperture section 25. Mount section 23 extends annularly along the top edge of pill-return funnel 20. Aperture section 25 is coupled to funnel mount 38 on both sides of mount section 23 and is arranged to extend along sloped side wall 40 to define a portion of pill-outlet aperture 32 and pill-return aperture 34.

Aperture section 25 includes a first outlet section 27, a second outlet section 29, and an inlet section 31 as shown in FIG. 12. Inlet section 31 is arranged in a fixed position relative to the sloped side wall 40 and has a semi-circular shape at the bottom of sloped side wall 40 forming a portion of a boundary for pill-return aperture 34. First and second outlet sections 27, 29 are located between inlet section 31 and mount section 23 forming a portion of a boundary for pill-outlet aperture 32.

Neck mount 24 includes a mount thread 44 coupled to a mount housing 42, as shown in FIG. 4, which couples the pill dispenser 18 to the container to allow pills to flow from the interior product-storage region 14 through a filler neck 48 and into the pill-dispensing cap 22. Neck mount 24 underlies container closure 16 and is connected to container 12 using the mount threads 44 and the mount housing 42 as shown in the sectional view in FIG. 4. Mount housing 42 has an annular shape to allow it to be connected to the filler neck 48 using the mount threads 44 and neck threads 46.

Filler neck 48 is coupled to sidewall 52 of body 50 as shown in FIGS. 4 and 5. Filler neck 48 is located spaced-apart from floor 51 to locate sidewall 52 therebetween. Filler neck 48 is configured to concentrate the flow of pills 11 from interior product-storage region 14 before they exit through pill-outlet aperture 32. Filler neck 48 is coupled to a top edge of container 12, as shown in FIG. 2, to allow pills 11 to flow directly into the pill-dispensing cap 22 and rest in the pill-receiving dish 26 as shown in FIG. 9. It is within the scope of the present disclosure to retain the shape of container closure 16 on container 12 using any suitable means and to provide container 12 with any suitable size and shape. While filler neck 48 has an annular shape in the illustrated embodiment, any suitable shape may be used in accordance with the present disclosure.

Pill-dispensing package 10 further includes, for example, a child-resistant lock 30 to block removal of container closure 16 from container 12 as shown in FIGS. 4, 6, and 7. Child-resistant lock 30 includes annular ridge 30A, an engagement tab 30T, and a release region 30R. Annular ridge 30A extends outwardly from filler neck 48. Engagement tab 30T extends inwardly from container mount 33 as shown in FIG. 4. Release region 30R is located along annular ridge 30A. Child-resistant lock 30 is configured to rotate around central axis A between an engaged position as shown in FIG. 6 to a disengaged position wherein engagement tab 30T is arranged to pass axially through release region 30R allowing a user to remove container closure 16 as shown in FIG. 7.

In some embodiments, body 50 has an oval shape but it is within the scope of the present disclosure to include any suitable size and shape for body 50 of the pill-dispensing package 10. In some embodiments, container closure 16 normally is coupled to container 12, and pill dispenser 18 is located between container 12 and container closure 16, as shown in FIG. 5. Pill dispenser 18 may be configured to provide means for transferring a single pill from interior product-storage region 14 to a user without the user touching any of the other pills so that an unexpected release of additional pills from container 12 is minimized.

A sequence illustrating the process of discharging a pill 11 from pill-dispensing package 10 in accordance with the present disclosure is shown, for example, in FIGS. 6-10. Container closure 16 further includes child-resistant lock 30 as shown in FIGS. 6 and 7. Child-resistant lock 30 blocks access to interior product-storage region 14 by coupling to the container 12 as shown in FIG. 6. Child-resistant lock 30 is engaged when container closure 16 has been mounted to the container and then rotated around central axis A as shown in FIG. 6. Child-resistant lock 30 is disengaged and allows the lid to be removed when it is arrange in the position shown in FIG. 7.

A sequence for discharging a single pill 11 once child-resistant lock 30 has been disengaged is shown in FIGS. 8-10. Container 12 is first tilted on its side to move pills 11 from interior product-storage region 14 to pill-receiving dish 26, as shown in FIG. 9. Lastly, the container 12 may be twisted left or right, as shown in FIG. 10, to dispense a single pill through either first or second pill-discharge units 35, 36.

The invention claimed is:

1. A pill-dispensing package comprising a container formed to include an interior pill-storage region therein, the container including a body defining a portion of the interior pill-storage region and a filler neck coupled to the body to define a remaining portion of the interior pill-storage region, a container closure coupled to the container, and a pill dispenser coupled to the filler neck of the container and arranged to lie between the container closure and the filler neck, wherein the pill dispenser is configured to dispense pills from the interior pill-storage region through a pill-outlet aperture to a pill-receiving dish in response to tilting the container and the pill dispenser to a partly inverted position so that spilling of pills stored in the interior pill-storage region is minimized wherein the pill dispenser includes a neck mount coupled to the filler neck in a fixed position relative to the filler neck and a pill-dispensing cap coupled to the neck mount and arranged to extend upwardly away from the neck mount towards the container closure, wherein the pill-dispensing cap includes the pill-receiving dish coupled to the neck mount and arranged to extend upwardly away from the neck mount and the filler neck, a first discharge unit arranged to extend between and interconnect the neck mount and the pill-receiving dish, and a second discharge unit arranged to extend between and interconnect the neck mount and the pill-receiving dish, each pill discharge unit configured to dispense a single pill from the pills in the pill-receiving dish, wherein the pill-receiving dish is configured to receive a plurality of pills in the partly inverted position, and in response to a further tilting of the pill-dispensing package, a single pill is dispensed from the pill receiving dish via the first or second discharge unit, and wherein the pill-receiving dish is a curved wall having two edges, each edge including a base, a platform, and an arm interconnecting the base and the platform, wherein the pill-receiving dish has a wider dimension at the platform than at the arm, and the pill-discharge units are located at each arm.

2. The pill-dispensing package of claim 1, wherein the pill-receiving dish defines a portion of a pill-receiving space formed in the pill-dispensing cap and an aperture is formed in the neck mount which is in communication with the interior pill-storage region and the pill-receiving space.

3. The pill-dispensing package of claim 2, wherein the first discharge unit is formed to include a discharge aperture arranged to be in communication with the pill-receiving space.

4. The pill-dispensing package of claim 1, wherein the pill dispenser further includes a pill-return funnel arranged to extend between and interconnect the pill-dispensing cap and the neck mount.

5. The pill-dispensing package of claim 4, wherein the pill-return funnel includes a funnel mount coupled to the neck mount and a sloped side wall coupled to the funnel mount and arranged to extend downwardly away from the pill-dispensing cap toward the filler neck.

6. The pill-dispensing package of claim 5, wherein the sloped side wall is formed to include a pill-outlet aperture arranged to be in communication with the interior pill-storage region.

7. The pill-dispensing package of claim 6, wherein the sloped side wall is further formed to include a pill-return aperture arranged to be in communication with the interior pill-storage region.

8. The pill-dispensing package of claim 7, wherein the pill-return aperture is arranged to be in communication with the pill-outlet aperture.

9. The pill-dispensing package of claim 8, wherein pill-receiving dish is coupled to the pill-return funnel and arranged to extend upwardly away from the pill-return funnel and the filler neck and the first discharge unit is arranged to extend between and interconnect the pill-return funnel and the pill-receiving dish.

10. The pill-dispensing package of claim 9, wherein the pill-receiving dish defines a portion of a pill-receiving space formed in the pill-dispensing cap and the pill-outlet aperture is arranged to be in communication with the interior pill-storage region and the pill-receiving space.

11. The pill-dispensing package of claim 10, wherein the first discharge unit is formed to include a discharge aperture arranged to be in communication with the pill-receiving space.

12. A pill-dispensing package comprising a container formed to include an interior pill-storage region therein, the container including a body defining a portion of the interior pill-storage region and a filler neck coupled to the body to define a remaining portion of the interior pill-storage region, a container closure coupled to the container, and a pill dispenser coupled to the filler neck of the container and arranged to lie between the container and the filler neck, wherein the pill dispenser is configured for transferring pills from the interior pill-storage region through a pill-outlet aperture to a pill-receiving dish in response to tilting the container and pill dispenser to a partly inverted position so that spilling of pills stored in the interior pill-storage region is minimized, and first and second pill-discharge units each configured to dispense a single pill of the transferred pills in the pill-receiving dish in response to a further tilting of the pill-dispensing package in a direction of one of the first and second pill-discharge units, and wherein the pill-receiving dish is a curved wall having two edges, each edge including a base, a platform, and an arm interconnecting the base and the platform, wherein the pill-receiving dish has a wider dimension at the platform than at the arm, and the pill-discharge units are located at each arm.

* * * * *